US006305959B1

(12) United States Patent
Baker et al.

(10) Patent No.: US 6,305,959 B1
(45) Date of Patent: Oct. 23, 2001

(54) ELECTRICAL CONNECTOR WITH LOCK

(75) Inventors: William P. Baker, Salt Lake City; Douglas S. Reynolds, Clinton, both of UT (US)

(73) Assignee: Iomega Corporation, Roy, UT (US)

( * ) Notice: Subject to any disclaimer, the term of this patent is extended or adjusted under 35 U.S.C. 154(b) by 0 days.

(21) Appl. No.: 09/475,942

(22) Filed: Dec. 30, 1999

(51) Int. Cl.[7] ..... H01R 29/00
(52) U.S. Cl. ..... 439/188; 439/352
(58) Field of Search ..... 439/188, 352, 439/357, 358, 911, 76.1

(56) References Cited

U.S. PATENT DOCUMENTS 4,971,569 * 11/1990 Gooch et al. ..... 439/188
5,890,520 9/1998 Edward et al. ..... 711/115
5,993,230 * 11/1999 Gauker et al. ..... 439/188

FOREIGN PATENT DOCUMENTS

0624925A1 * 11/1994 (EP) .

* cited by examiner

*Primary Examiner*—Khiem Nguyen
(74) *Attorney, Agent, or Firm*—Woodcock Washburn Kurtz Mackiewicz & Norris LLP

(57) ABSTRACT

A connector making electrical contact with a mating connector includes a base which is slidable in the housing in initial movement to plug or unplug the connector into the mating connector. This initial movement cams the tension arms mounted on the printed circuit board of the connector to rotate hooks on the connector to unlock it from its mating connector. The connector includes a second set of contacts having a different electrical configuration which allows a hot-swappable connection.

22 Claims, 13 Drawing Sheets

ELECTRICAL CONNECTOR WITH LOCK

This application relates to an electrical connector and more particularly to an electrical connector which is locked in place during use, retained during shock loads, and easily released.

BACKGROUND OF THE INVENTION

Electrical connectors interconnect various electrical devices, particularly computer devices. U.S. Pat. No. 5,809,520 Edwards et al. and related patents and applications show and describe various storage devices such as disk drives. Zip™, Zip Notebook, and CLIK!™ drives are typical storage devices which are interconnected in a computer system by electrical cables which have standardized connectors.

The Universal Serial Bus follows a protocol defined in the Universal Serial Bus Specification (USB Spec). The USB Spec provides a standardized approach for peripheral interconnections with a host computer. The USB is set up in a tiered topology with a host on the top tier and USB hubs and functions on subsequent tiers. Each USB device, whether it be a hub or a function, has associated therewith a serial interface engine (SIE) which provides an interface between the hub or function and the transceiver which transmits or receives signals across the serial line. Generally, the SIE takes care of all the USB low level protocol matters such as bit stuffing, cycle redundancy checks (CRCs), token generation, and handshaking. ATAPI is a standard for the connectors, sometimes referred to as Centronics connectors, used to interconnect the peripherals and the host computer.

The IEEE 1394-1995 standard was adopted on Dec. 12, 1995 by the Institute of Electrical and Electronic Engineers, 345 East 47$^{th}$ St., New York, N.Y. 10017-2394. A copy of that standard is available from the IEEE. The standard is widely known in the industry of digital video, particularly since IEEE-1394-1995, also known as Fire Wire™ (trademark of Apple Computer, Inc., Cupertino, Calif. 95014), has been adopted as the standard for connecting digital video cameras and other digital video devices in the consumer and professional markets. The contents of that standard are incorporated herein by reference (IEEE 1394 Specification).

It is an object of the present invention to provide a connector for such cabling systems which can be locked into place during use, retained during shock loads, and easily released by gripping the housing and pulling the connector apart.

SUMMARY OF THE INVENTION

In accordance with the present invention, an electrical connector includes a base, or printed circuit board, which contains a 50 pin Centronics connector, an IEEE 1349 connector, two retention arms and other electrical components. A housing for the base has two slots in which the base is slidable for a short distance of initial movement. The two retention arms on the base lock the connector to mating members on a mating connector. As the base slides with respect to the housing during initial movement, features on the housing cam the arms outwardly to release the lock.

Further in accordance with the invention, a spring on the base is compressed when the mating connector is inserted into the connector of the present invention. The inherent frictional force of the electrical contacts hold the base in place against the compression force of the spring. The frictional force between the contacts is slightly larger than the force required to compress the spring member. When the mating connector is pulled away from the housing, the compressional force of the spring overcomes the frictional forces of the contacts.

Further in accordance with the invention, a second set of electrical contacts compatible with a mating connector having a different electrical configuration are also mounted on the base. For example, the base, or printed circuit board of the connector of the present invention contains both a 50 pin Centronics connector and an IEEE 1394 connector. When the spring on the base is fully compressed and the assembly bottoms out, the mating contacts are forced apart breaking the circuit between them. At this time, the arms are also fully extended outwardly by the cam motion of the plastic making it possible to overcome the interlock.

If a 1394 cable connector is engaged with its mating connector, the overmold on the cable causes an interference with the plastic housing thus making it difficult, if not impossible, to disengage the Centronics connector. This is desired since the 1394 connection is designed as a hot-swappable connection and the Centronics is an ATAPI connection which is not hot-swappable.

With the 1394 cable connector disengaged, the plastic can be operated by grabbing it in almost any fashion. The only requirement is that the forces applied to the plastic be along the engagement of the Centronics connector so as to disengage this connection. Once the connection is released, the spring member returns the plastic to the 'at rest' position where the process began.

The foregoing and other objections, features and advantages of the invention can be understood from the following more detailed description and appended claims.

SHORT DESCRIPTION OF THE DRAWINGS

DESCRIPTION OF THE PREFERRED EMBODIMENT

Figure 1:
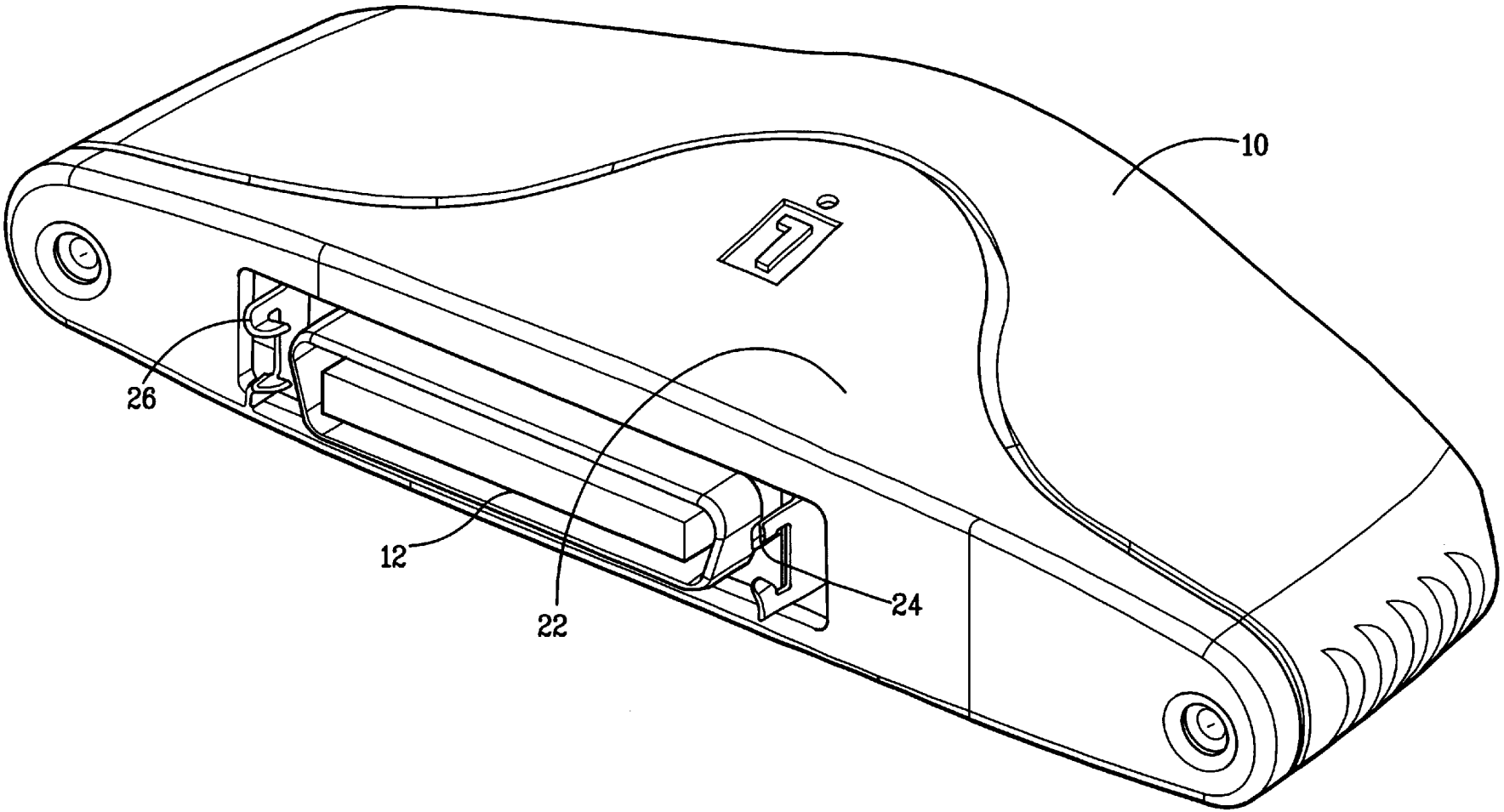
FIG. 1 is a perspective view of a disk drive with the connector of the present invention.

FIG. 1 shows housings, 10 and 22, for a connector to a disk drive which can be the aforementioned Zip drive which is capable of connection to a mating connector compatible with the aforementioned USB and IEEE1394 connectors. The connector 12 of the present invention provides compatibility with these mating connectors.

Figure 2A:
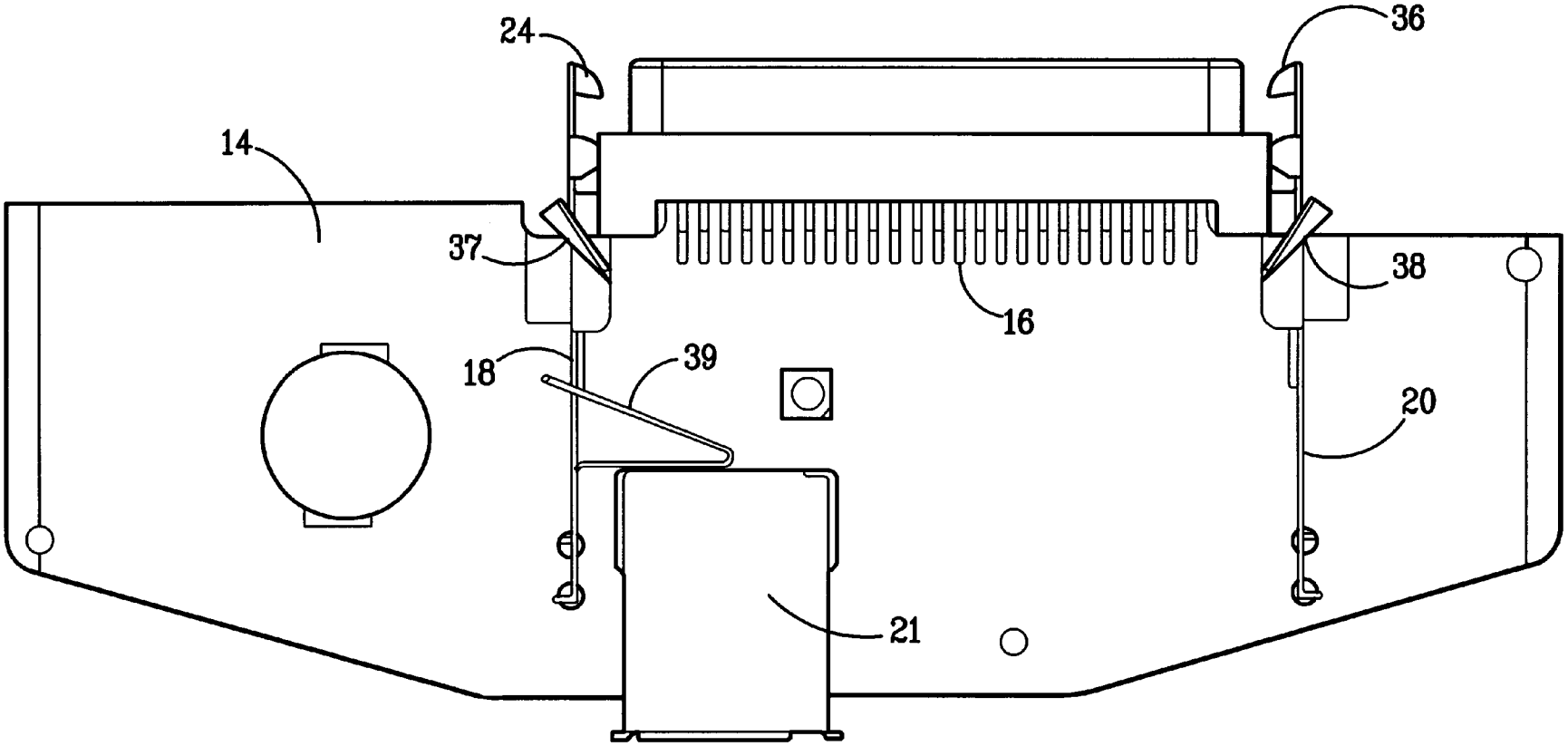
FIG. 2A shows the printed circuit board having a 50 pin Centronics connector, an IEEE 1394 connector, two retention arms and other electrical components.

FIG. 2A shows the connector of the present invention which has a base 14 which is a printed circuit board having components mounted thereon. Electrical contacts 16 on the base are compatible with contacts in an electrical configuration compatible with USB, typically in a Centronics connector. The board also mounts two retention arms 18 and 20 and the housing 21 for a IEEE 1394 connector.

Figure 2B:
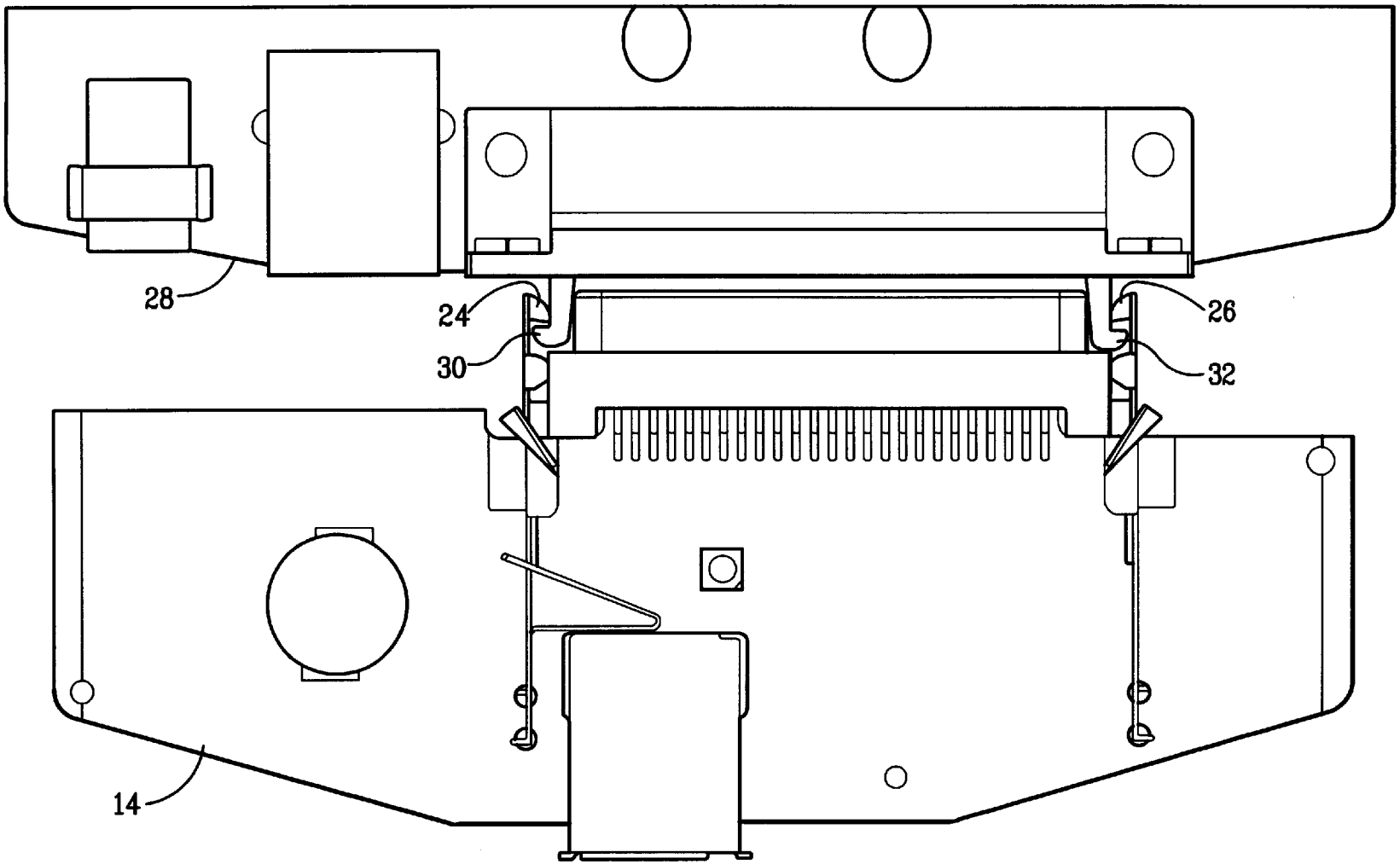
FIG. 2B shows the connector of FIG. 2A with the Centronics connector mated to its associated contacts and the retention arms engaged with their associated mating members in the locked position as is the case with the cable and mating connector connected to the disk drive through the connector of the present invention.
Figure 3:
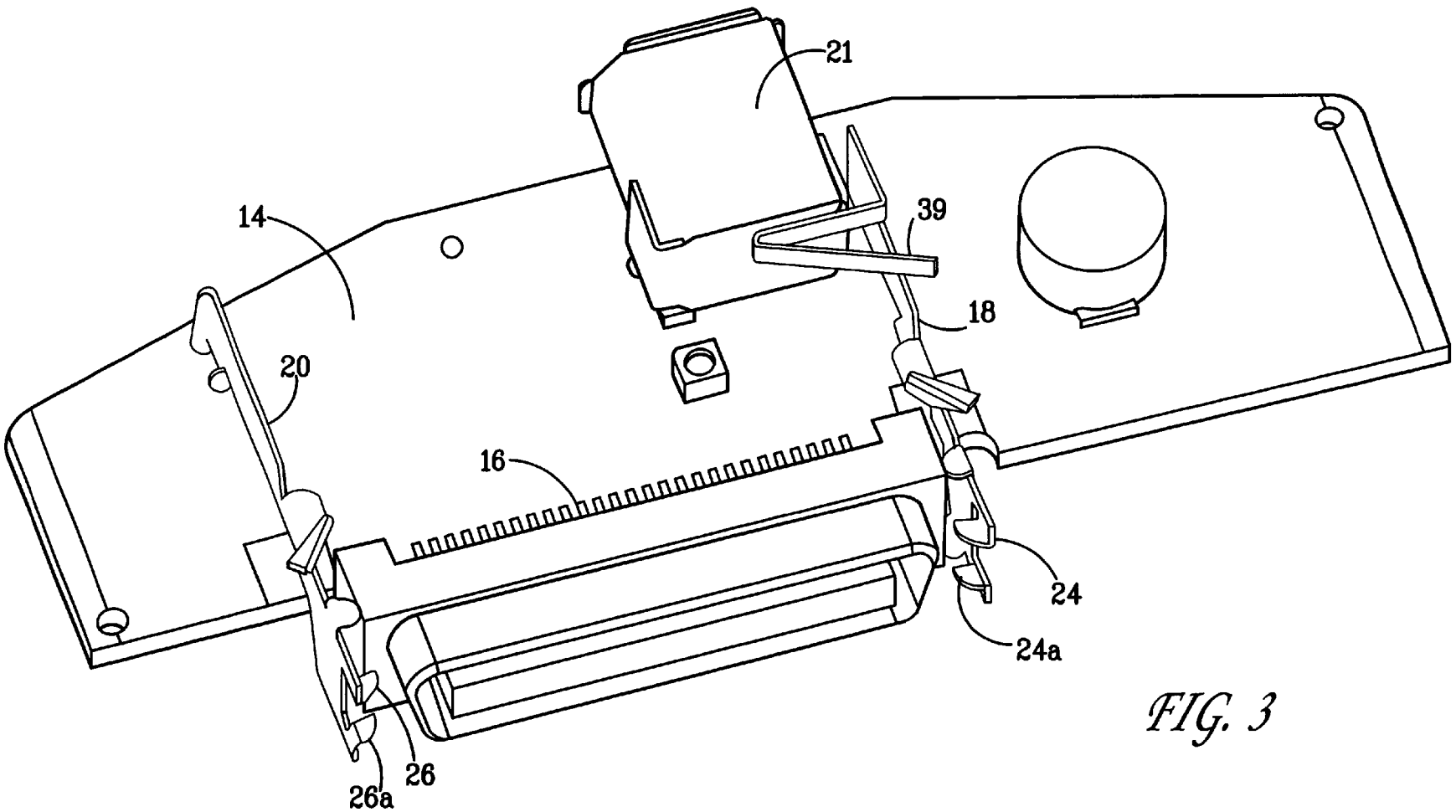
FIG. 3 is an isometric view of the assembly of FIG. 2.
Figure 4:
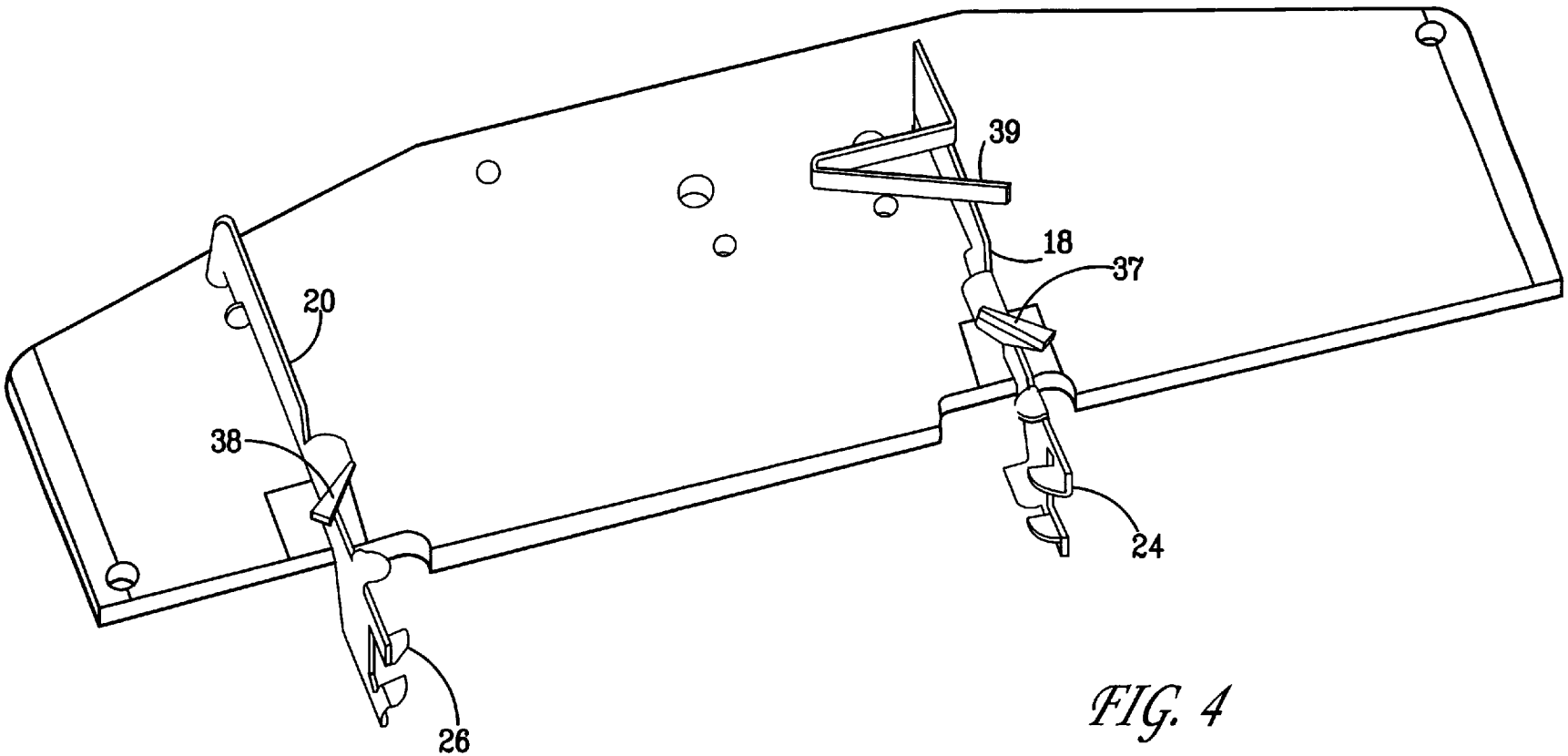
FIG. 4 shows the printed circuit board and retention arms.
Figure 5:
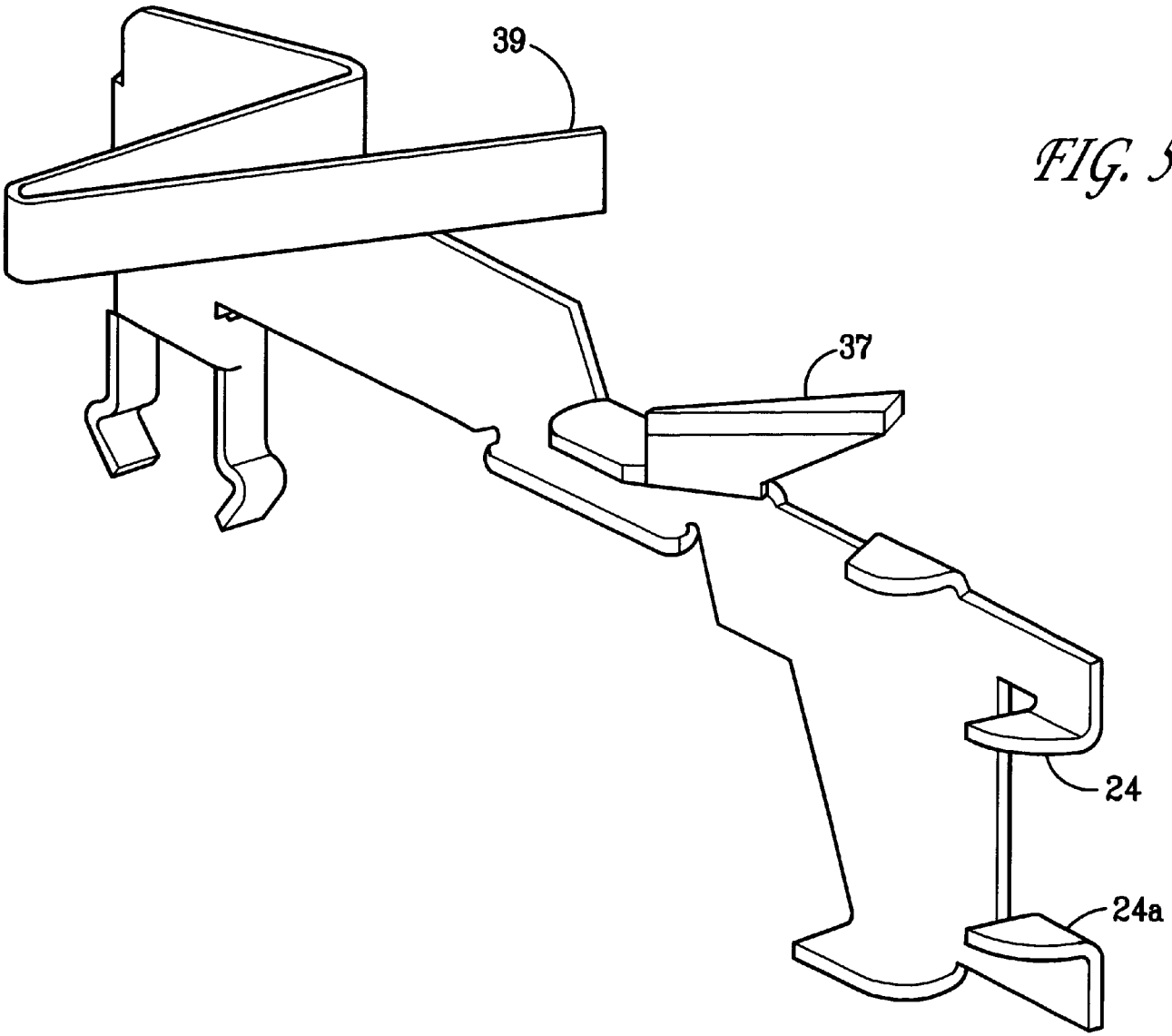
FIG. 5 shows a single retention arm.
Figure 6:
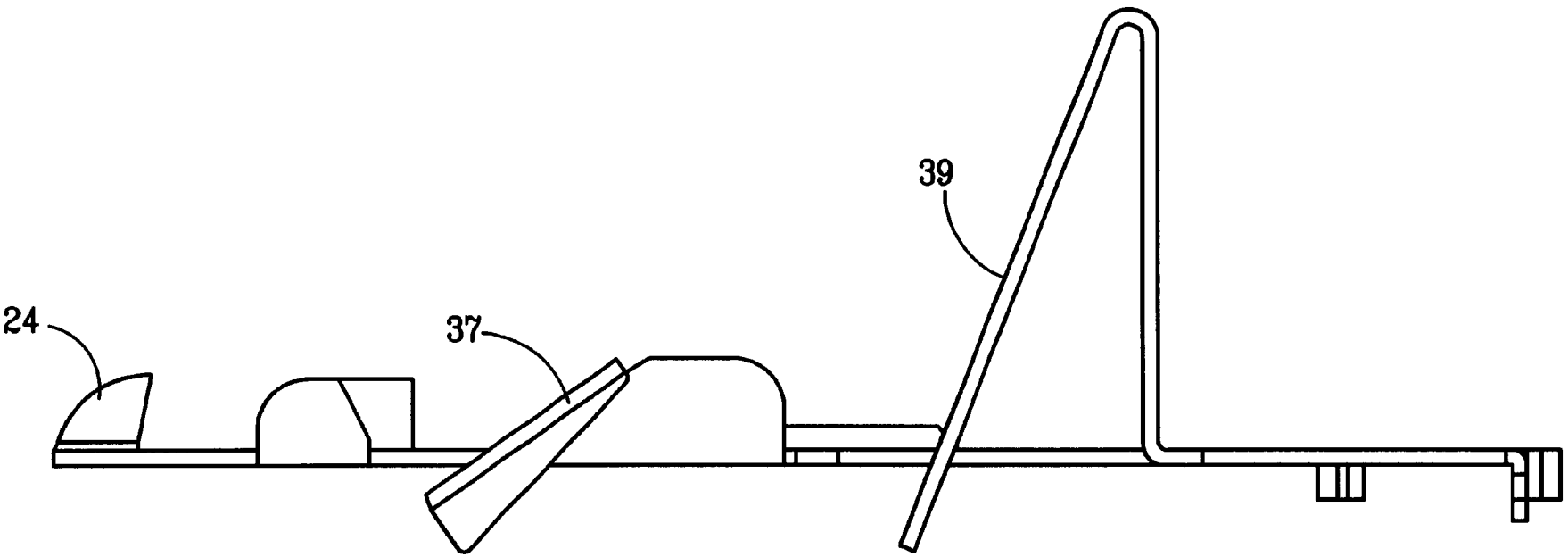
FIG. 6 shows a top view of the retention arm.
Figure 7:
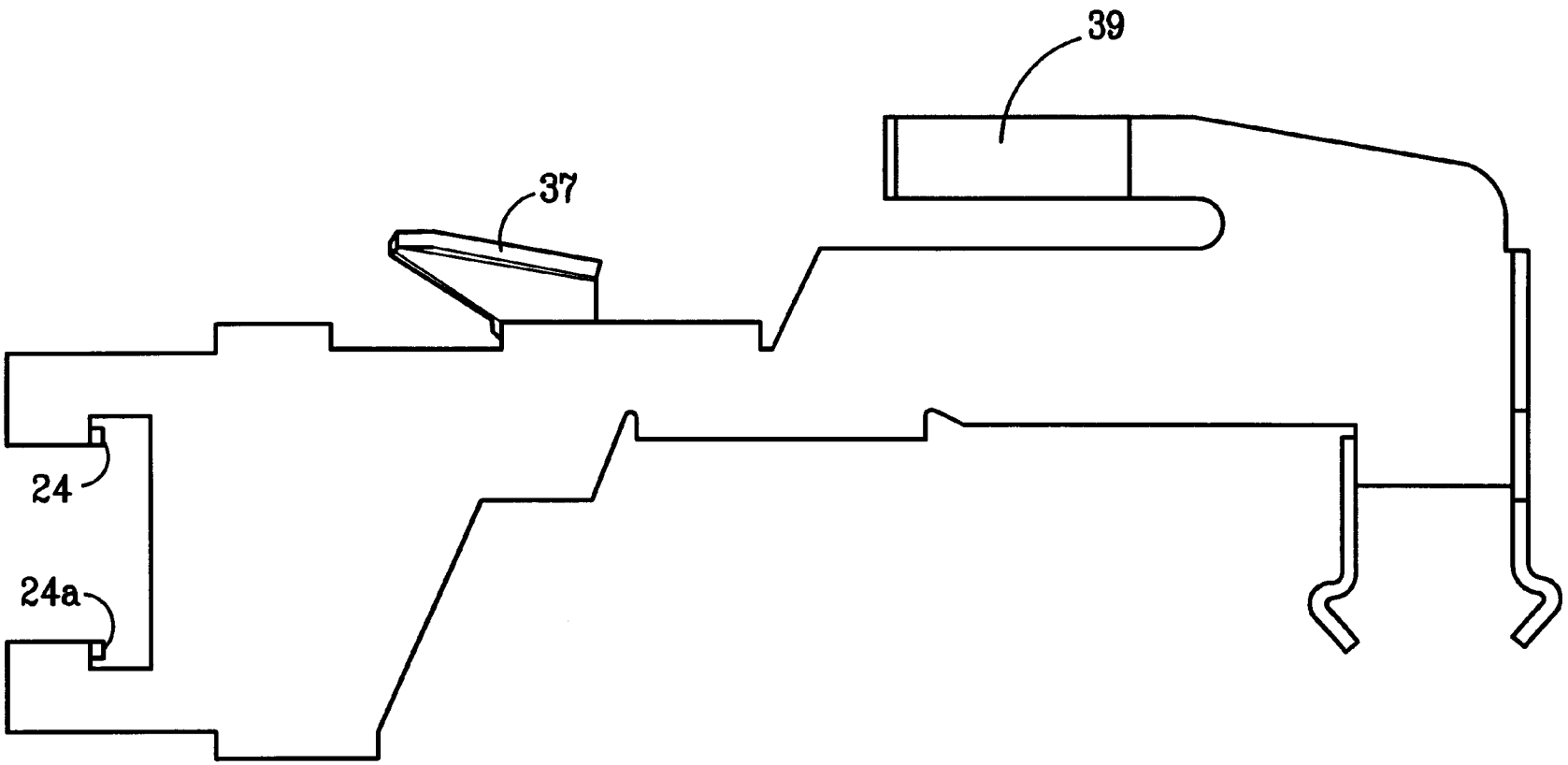
FIG. 7 shows a right side view of the retention arm.
Figure 9:
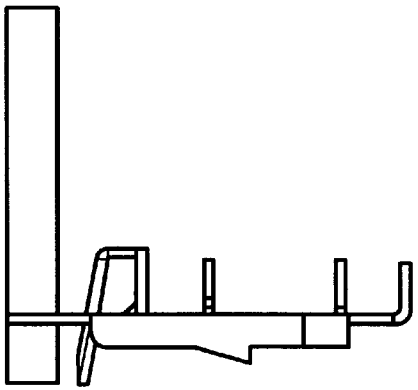
FIG. 9 shows a rear view of the retention arm.
Figure 8:
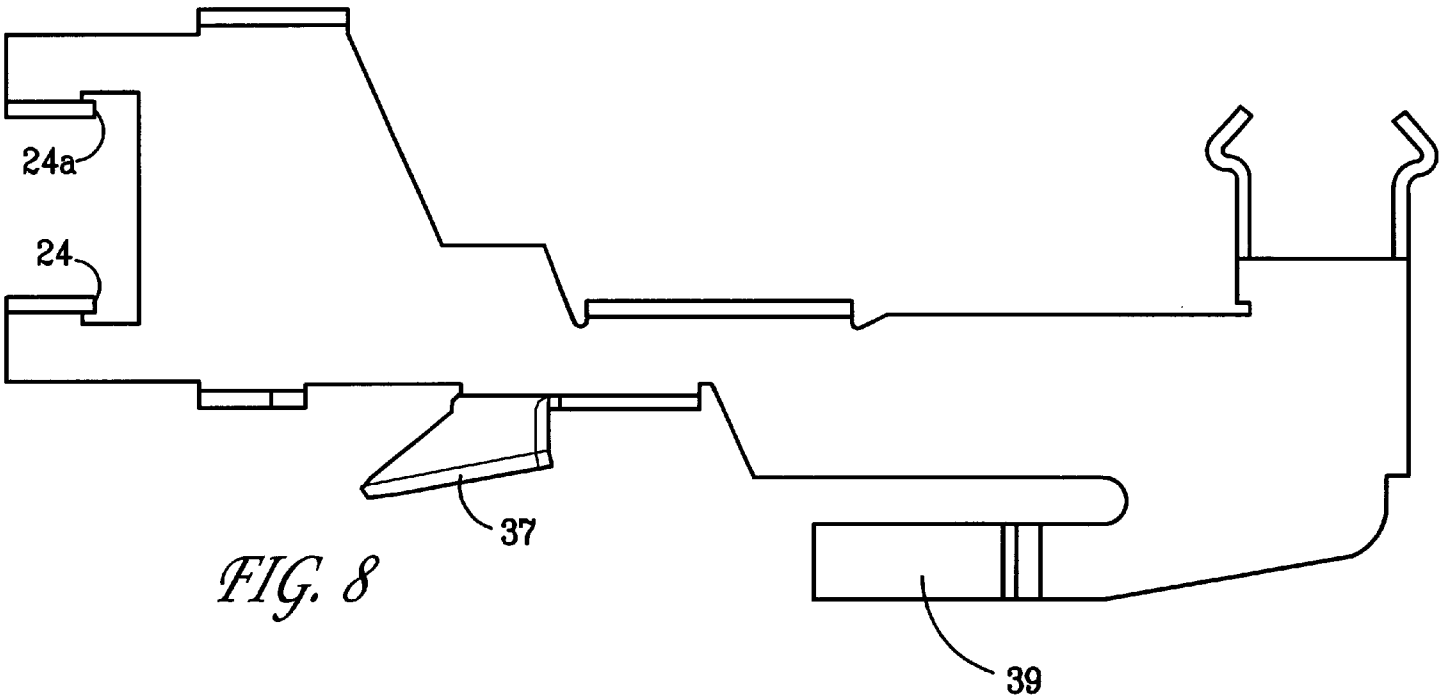
FIG. 8 shows a left side view of the retention arm.

FIG. 2B shows the same printed circuit board 14 connected to a mating connector 28 typically on the disk drive. Hooks 24 and 26 on retention arms 18 and 20 mate with hooks 30 and 32 on mating connector 28 to lock the connector of the present invention in place during use and retain it against shock loads.

Figure 12:
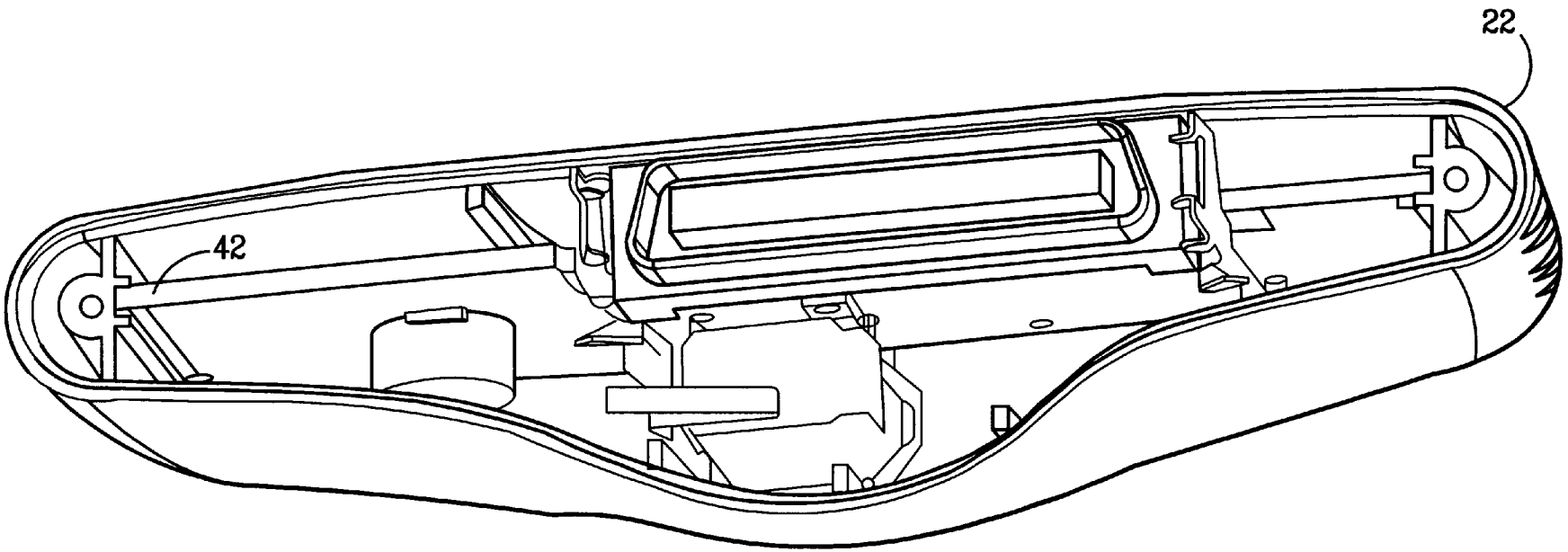
FIG. 12 is a front view of the housing with the printed circuit board resting in slots therein.

The printed circuit board is enclosed in a plastic housing 22, 10 and (FIGS. 1 and 12).

Figure 10:
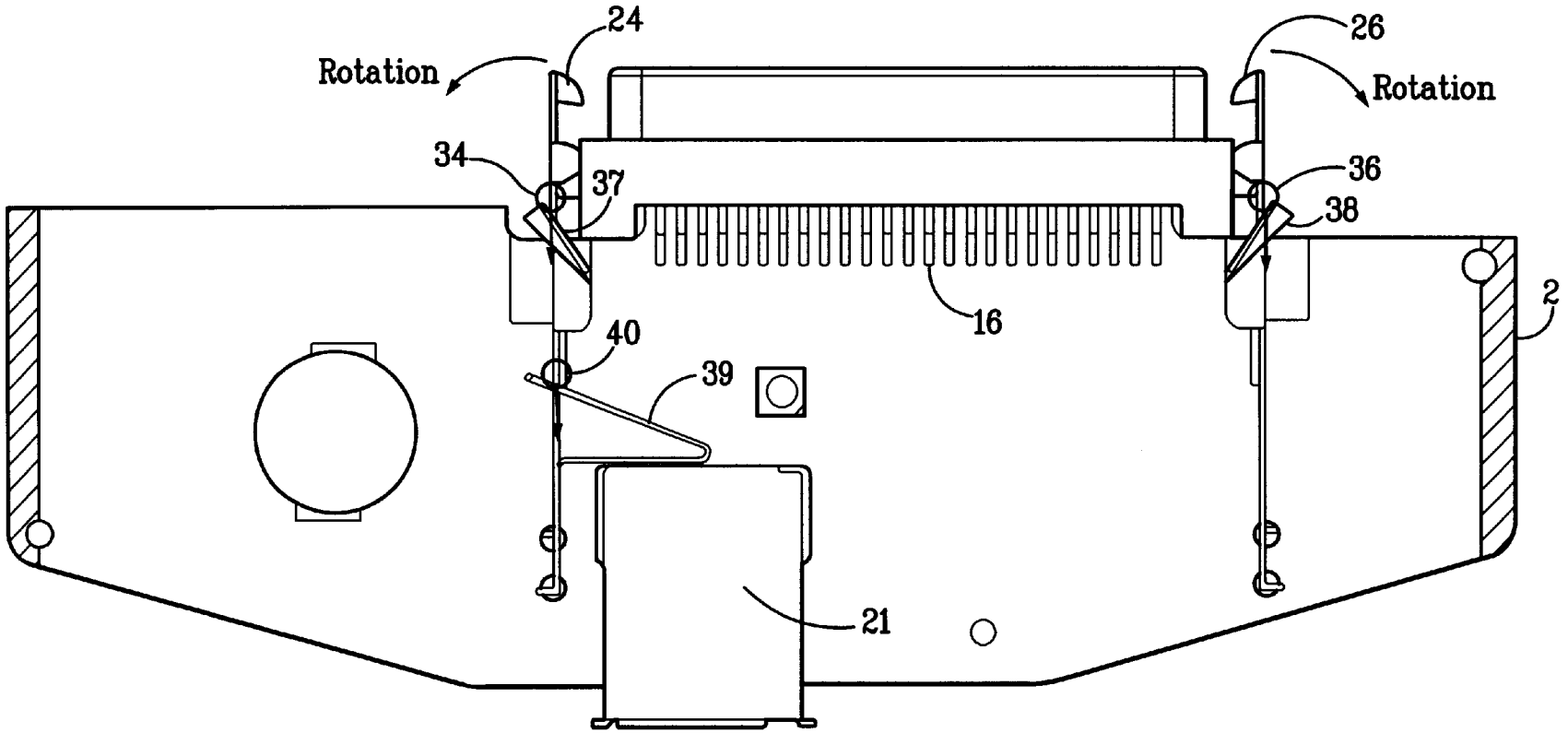
FIG. 10 is similar to FIG. 2A with the addition of features of the housing.
Figure 13:
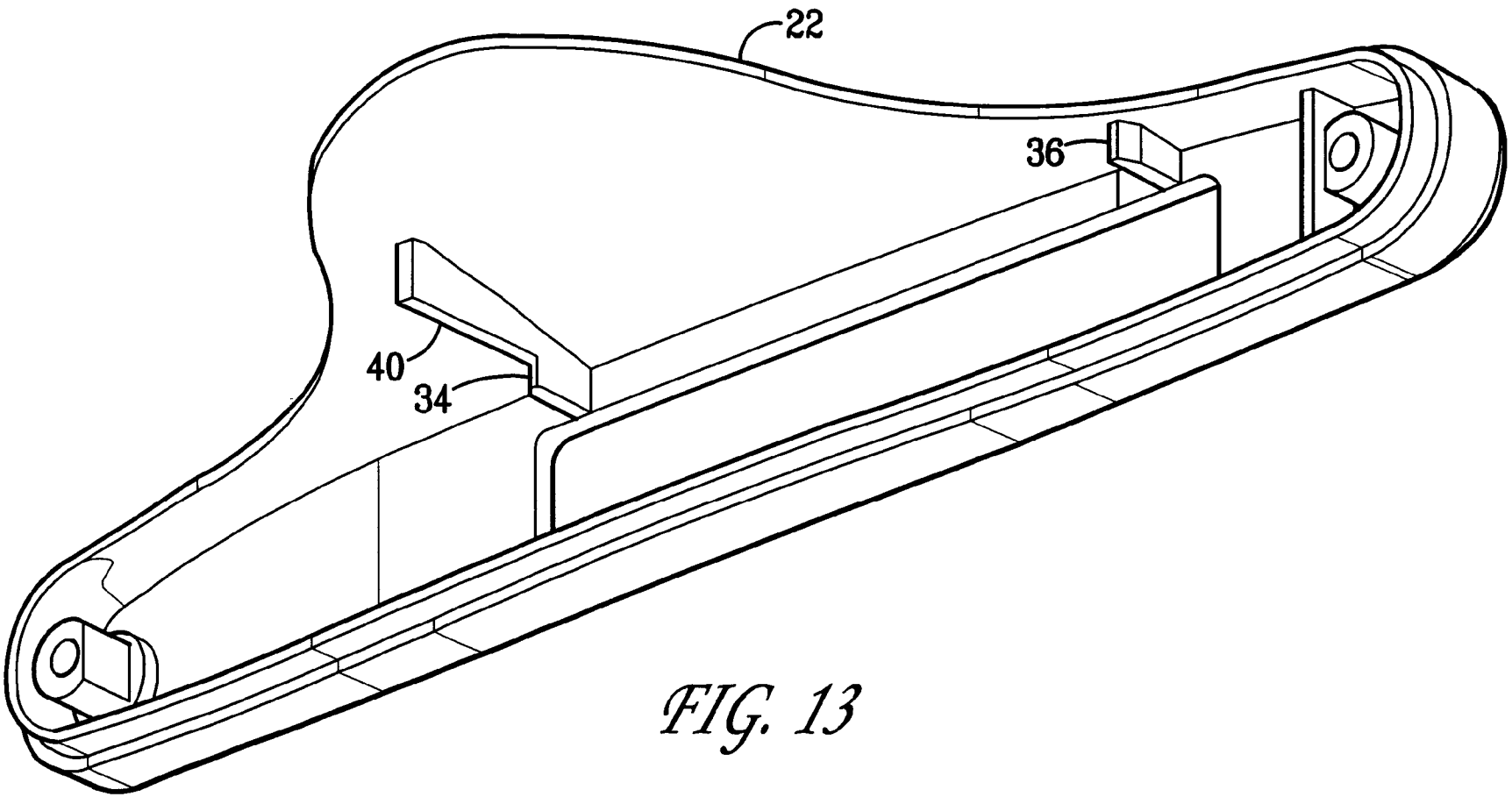
FIG. 13 is a view of the housing showing the bosses in more detail.

FIG. 10 is like FIG. 2B with the addition of mating features on the plastic housing 22. These include bosses 34 and 36 (FIG. 13) which bear against protrusions 37 and 38 on the spring arms 18 and 20. The printed circuit board 14 slides in the direction of the arrows in FIG. 10. The printed circuit board rides on the extreme left and right edges (shown with hatching in a FIG. 10) in two grooves 42 and 44 in the plastic housing (see FIG. 12). As the plastic housing 22 moves in the direction of the arrows the bosses 34 and 36 on the housing cause the arms 18 and 20 to rotate, or cam, outwardly. This opens the lock between the hooks 24 and 26 and the mating hooks 30 and 32 on the mating connector 28. This allows the connector to be removed.

The movement of the mating connector into the connector of the present invention is referred to as the "pluggable" direction. During movement in this direction, a spring 39 on the printed circuit board is compressed by a third boss 40 (FIG. 13) on the plastic housing 22. The printed circuit board 14 is held in place against the compression force of spring 39 by the inherent frictional force of the contacts 16 of the 50 pin Centronics connector. When the spring 39 is fully compressed and the assembly bottoms out, the mating contacts are forced apart breaking the circuit between them. At this time, the arms 18 and 20 are fully extended outwardly by the cam motion caused by contact between bosses 34 and 36 and the protrusions 37 and 38 on the retention arms. When the arms 18 and 20 are fully extended outwardly by the camming motion, it is possible to overcome the interlock.

Figure 11:
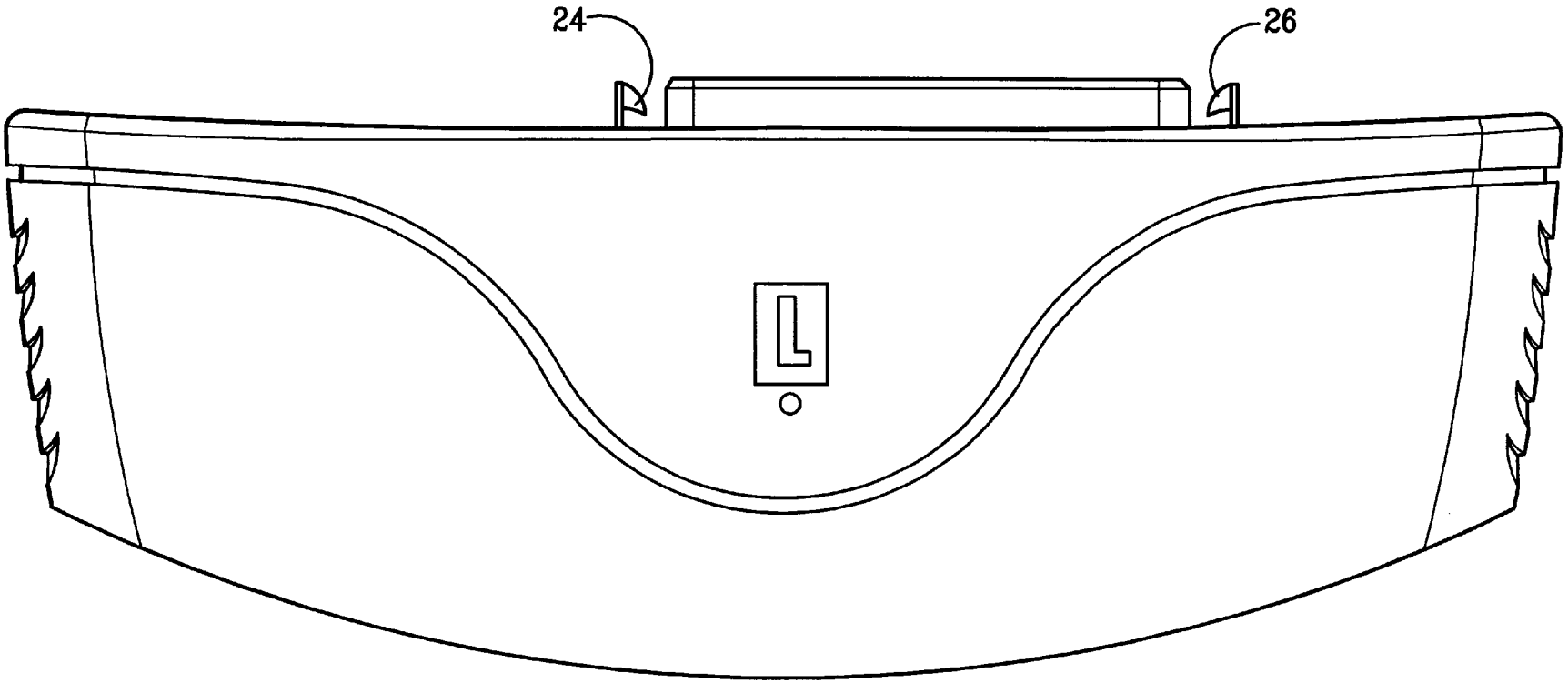
FIG. 11 is a top view of the connector of the present invention.

If a mating connector is engaged with the connector in the housing 21, i.e. with the 1394 cable connector, the overmold on the cable causes an interference with the plastic housing making it impossible to disengage the connector. (FIG. 11) This is desired since the 1394 connection is designed as a hot-swappable connection whereas the Centronics connector provides an ATAPI connection which is not hot-swappable.

In a hierarchy of peripherals connected with ATAPI connections, it is necessary to remove power from the bus before disconnecting the connectors. This is referred to as not being "hot-swappable" when peripheral connections are changed. On the other hand, the IEEE 1394 connections are hot-swappable.

In the connector of the present invention, when the mating connector is moved in the unpluggable direction, the IEEE 1394 connections are broken first, which is acceptable even if the power is on. This disconnection removes power from all busses including the ATAPI bus. Further movement in the unpluggable direction opens the locking "jaws" formed by the hooks 24 and 26 on the retention arms. Then the Centronics connector can be safely disconnected.

While a particular embodiment of the invention has been shown and described, various modifications may be made. The appended claims are, therefore, intended to cover all such modifications within the true spirit and scope of the invention.

What is claimed is:

1. An electrical connector making electrical connections with mating connectors comprising:

a base;

electrical contacts on said base;

a housing for said base;

a retention arm on said base forming a lock between said connector and mating members on a mating connector; and said base being slidable with respect to said housing so that initial movement between said mating connector, said connector and said housing opens said lock between said connector and said mating connector.

2. The connector recited in claim 1 further comprising two of said retention arms, each of said retention arms having a hook which mates with a hook on said mating connector.

3. The connector recited in claim 2 wherein said arms are cammed outwardly by two features on said housing during said movement.

4. The connector recited in claim 3 wherein said hooks are rotated as said arms are cammed outwardly.

5. The connector recited in claim 4 wherein said base is slidable in a pluggable direction and in an unpluggable direction.

6. The connector recited in claim 3 further comprising a spring on said base.

7. The connector recited in claim 6 further comprising:

a third feature on said housing which compresses said spring as said housing moves relative to said base in the pluggable direction.

8. The connector recited in claim 6 wherein said electrical contacts have sufficient frictional force with contacts in said mating connector to maintain the compression between said spring and said housing.

9. The connector recited in claim 5 wherein said features are bosses in said housing.

10. The connector recited in claim 8 wherein said housing is molded plastic with said bosses molded therein.

11. The connector recited in claim 9 wherein said housing has two grooves molded therein, said base being slidable in said grooves.

12. The connector recited in claim 1 wherein said base is a printed circuit board with components mounted thereon.

13. The connector recited in claim 1 further comprising:

a second set of contacts having a different electrical configuration mounted on said base.

14. The connector recited in claim 13 further comprising:

a second housing for said second set of contacts;

a spring member on said base, a feature on said first mentioned housing compressing said spring is compressed against said second housing as said first housing moves relative to said base in a pluggable direction.

15. The connector recited in claim 13 wherein one set of said contacts has an electrical configuration which makes a connection which is hot-swappable and the other set of contacts has an electrical configuration which makes a connection which is not hot-swappable.

16. The connector recited in claim 15 wherein said one set of contacts is disconnected first upon movement in the unpluggable direction, further movement causing the opening of said lock, and further movement disconnecting said other set of contacts.

17. The connector recited in claim 1 in combination with a magnetic disk drive.

18. An electrical connector making electrical connections with mating connectors comprising:

a lock between said connector and said mating connector, said lock being opened by relative movement between said connectors;

a first set of contacts in an electrical configuration which is hot-swappable;

a second set of contacts in an electrical configuration which is not hot-swappable;

said first set of contacts being disconnected first upon movement in the unpluggable direction, further movement causing the opening of said lock, and further movement disconnecting said second set of contacts.

19. An electrical connector making electrical connections with a mating connector comprising:

a printed circuit board;

electrical contacts on said printed circuit board;

a housing for said printed circuit board;

a retention arm on said printed circuit board; said retention arm being part of a lock for locking said connector to mating members on a mating connector; and said printed circuit board being slidable with respect to said housing so that initial movement between said mating connector, said connector and said housing opens said lock between said connector and said mating connector.

20. An electrical connector making electrical connections with a mating connector comprising:

a base;

electrical contacts on said base;

a housing for said base;

a retention arm on base forming a lock for locking said connector to said mating connector; and a said printed circuit board being slidable with respect to said housing so that initial movement between said mating connector, said connector and said housing opens said lock between said connector and said mating connector;

a second set of contacts having a different electrical configuration mounted on said base;

a second housing for said second set of contacts; and a spring member on said base, a feature on said first mentioned housing compressing said spring against said second housing as said first housing moves relative to said base in a pluggable direction.

21. An electrical connector making electrical connections with mating connectors comprising:

a base;

electrical contacts on said base;

a housing for said base;

a retention arm on a printed circuit board forming a lock for locking said connector to mating members on a mating connector; and said base being slidable with respect to said housing so that initial movement between said mating connector, said connector and said housing opens the lock between said connector and said mating connector;

a second set of contacts having a different electrical configuration mounted on said base;

wherein one set of said contacts has an electrical configuration which makes a connection which is hot-swappable and the other set of contacts has an electrical configuration which makes a connection which is not hot-swappable.

22. The connector recited in claim 21 wherein said one set of contacts is disconnected first upon movement in the unpluggable direction, further movement causing the opening of said lock, and further movement disconnecting said other set of contacts.

* * * * *